United States Patent [19]

Martell

[11] Patent Number: 5,071,583

[45] Date of Patent: Dec. 10, 1991

[54] SOAP BAR HAVING A FIFTH FINGER GRIPPING MEMBER

[76] Inventor: Steve Martell, 391 Kensington Ave., Chicago, Ill. 60628

[21] Appl. No.: 566,777

[22] Filed: Aug. 14, 1990

[51] Int. Cl.[5] ..... C11D 17/04; A45D 40/00

[52] U.S. Cl. ..... 252/92; 252/134; 252/DIG. 16; 252/174; 401/88

[58] Field of Search ..... 252/92, 134, DIG. 16; 401/88

[56] References Cited

U.S. PATENT DOCUMENTS

| | | | |
|---|---|---|---|
| D. 122,728 | 9/1940 | Russell | D6/89 |
| D. 201,594 | 7/1965 | Woodard | D73/1 |
| D. 201,595 | 7/1965 | Woodard | D73/1 |
| D. 201,776 | 7/1965 | Woodard | D73/1 |
| D. 298,665 | 11/1988 | Bussell | D28/8.2 |
| 1,416,962 | 11/1921 | Meeks | 252/92 |
| 2,099,484 | 11/1937 | Hokerk | 87/23 |
| 2,243,634 | 11/1939 | Kadish | 252/92 |
| 2,988,841 | 6/1961 | Seufert | 252/92 |
| 2,988,842 | 6/1961 | Seufert | 45/28 |
| 3,671,438 | 6/1972 | Cilia | 252/90 |
| 4,062,792 | 12/1977 | McNabb | 252/93 |

FOREIGN PATENT DOCUMENTS 292291 6/1928 European Pat. Off. .

*Primary Examiner*—Paul Lieberman
*Assistant Examiner*—Erin M. Higgins
*Attorney, Agent, or Firm*—McAndrews, Held & Malloy, Ltd.

[57] ABSTRACT

A soaping device comprising a convention rectangular shaped bar of soap and a projecting member secured to the bar. The projecting member provides an aperture for receiving the user's fifth finger as a control point to provide a force opposed to the force applied by the user's thumb to the opposite side of the soap bar. The aperture is located both laterally spaced from the left surface edge of the bar and upwardly spaced from the central line axis of the bar. This point of positioning provides a control point which permits the user to manipulate the bar in a gripping fashion as well as providing a free and open area of soap for contact with the user.

10 Claims, 2 Drawing Sheets

Fig. 1
PRIOR ART
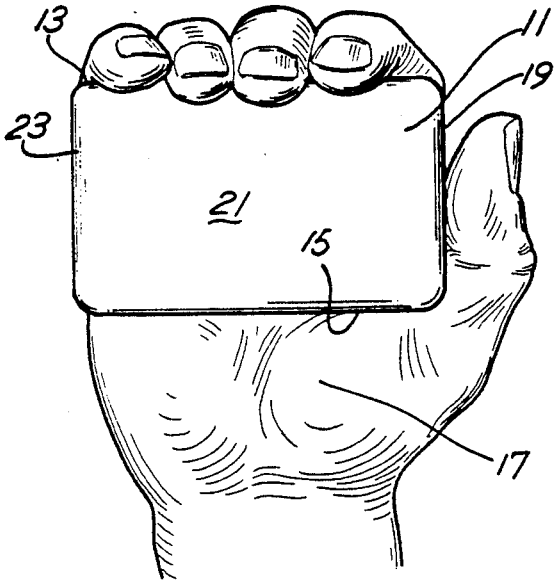
Fig. 2
PRIOR ART
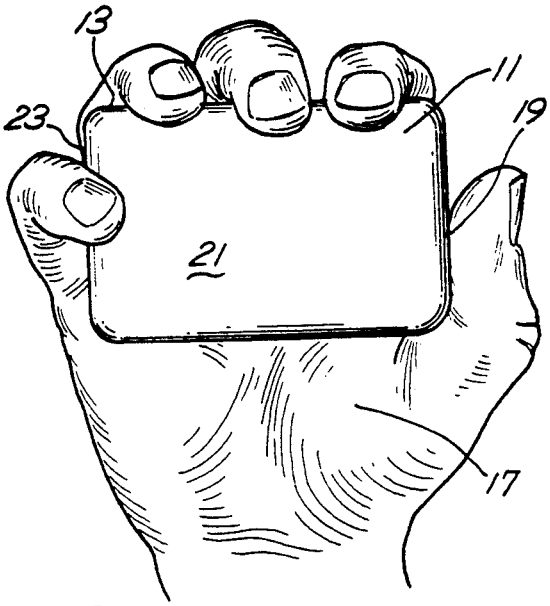
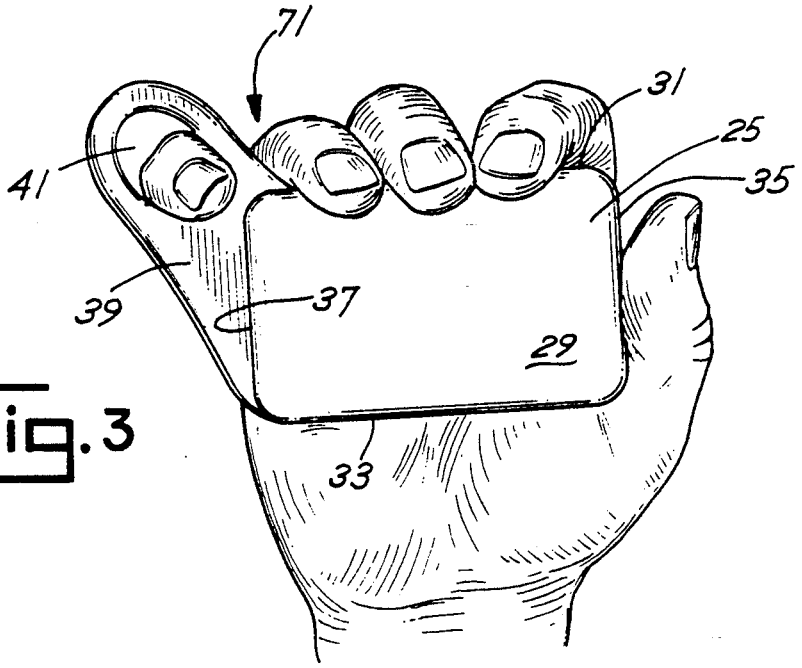
Fig. 3

SOAP BAR HAVING A FIFTH FINGER GRIPPING MEMBER

BACKGROUND OF THE INVENTION

The invention relates to a bar of soap which is manipuiable in conventional scrubbing fashion while at the same time providing structure which allows the bar to be gripped firmly by the user.

Heretofore, soap has been formed into a plurality of different shapes and includes the use of hooks or ropes in order to hang the bar from a pin or other device when the soap is not being used. For example, U.S. Pat. No. 3,671,438, issued to P. Cilia, discloses a circular bar of soap having a central aperture which receives a peg mounted in a soap dish. In another embodiment, the Cilia patent discloses a hook shaped soap configuration having a groove for receiving a hang-up peg. U.S. Pat. No. 4,062,792, issued to C. McNabb, discloses a soap cake construction in which an end extension is provided with a hole or hook for hanging the soap cake from a suitable hanger or support.

However, while such soap bars have the ability to be hung for drying purposes, they still must manipulated in a conventional body scrubbing fashion. The manipulation of such a bar of soap requires some dexterity since the bar of soap is generally slippery. The user must grasp the bar in such a fashion that it does not slip from the user's hand. In addition, the user would like to manipulate a rectangular bar or cake of soap in a brushing fashion having the largest flat area of the soap placed in physical contact with the body surface to be lathered. Often, the hang up hook may impede the soaping of the body and provide an obstacle which the user must contend with during manipulation of the soap when lathering the body.

SUMMARY OF THE INVENTION

Therefore, it is an object of the present invention to provide a bar of soap having a generally conventional rectangular cake form and which is easily manipulable by the user during bathing or showering.

It is yet another object of the present invention to provide a bar of soap which is grippable by the user in a quick fashion and permits conventional soap scrubbing of the body.

It is yet another object of the present invention to provide a conventional rectangular bar cake of soap which is grippable due to an added construction without impeding a conventional body scrubbing action.

These and other objects of the invention are achieved in a soaping device having a conventional rectangular shaped bar of soap. A fifth finger eye member is spaced laterally from one of the edge surfaces of the rectangular bar and provides a gripping surface for the fifth finger of the user. The user places three central fingers on the upper surface of the bar and places his thumb on the surface opposite to the fifth finger eye member.

DESCRIPTION OF THE DRAWINGS

FIG. 1 shows a prior art use of a conventional bar of soap wherein the user holds the bar in one hand.

FIG. 2 shows a second illustration of a prior art use of a bar of soap in which the user holds the bar in a different way in one hand.

FIG. 3 shows a side view of the preferred embodiment of the present invention being held by one hand of the user.

DESCRIPTION OF THE PREFERRED EMBODIMENT

Figure 4:
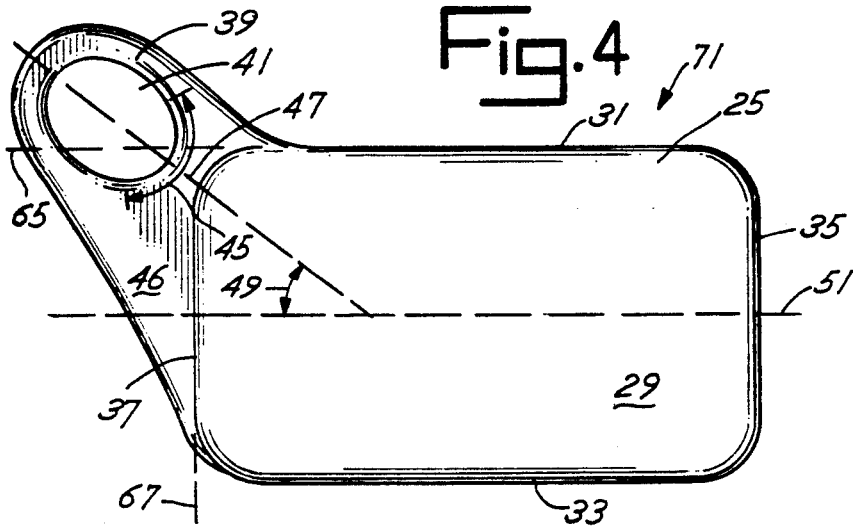
FIG. 4 shows a side view of the soap of FIG. 1.

Referring to FIGS. 1 and 2, a conventional soap bar 11 may be manipulated by the user in a variety of fashions. As shown in FIG. 1, the user curls four of his or her fingers over the top surface 13 of the soap bar and forces the lower surface 15 of the bar against the lower palm portion 17 of the user's hand. In addition, the user removes a thumb from in front of the outer face 21 of the soap and positions the thumb against the right side surface 19 of the bar. By holding the bar in this fashion, the user presents the outer face 21 of the soap for application in a side-to-side brushing or scrubbing fashion against the body of the user. As the soap bar is moved from side to side, the particular body part being contacted is lathered with soap.

In the gripping fashion shown in FIG. 1 the soap bar 11 contacts much of the palm of the hand, serving to nest the soap to prevent its slippage during bathing. However, the left edge 23 of the soap receives no direct holding contact and thus provides a path of slippage as the bar is driven from side to side in slippery conditions.

Referring to FIG. 2, soap bar 11 is illustrated as being manipulated or gripped by the user in a different fashion. The user attempts to provide some holding force on the left side edge 23 of the bar by moving the fifth finger downwardly and along the left side edge 23. This causes the user's three central fingers to rotate or slide leftwardly along the top surface 13 of the bar. Depending on the length of the bar, the bar slides upwardly away from the lower palm area 17 of the user's hand. This causes loss of contact or nesting of the bar in the palm of the user's hand. In order to bring the bar back into the lower palm, an unnatural forcing of the upper surface by the three central fingers drives the bar back downward into the palm. This is awkward and there is a tendency for both the thumb and the fifth finger to curl back in front of the face 21 of the bar providing interference to the face 21 contacting the body of the user during a scrubbing side-to-side action. However, moving the fifth finger to top surface 13, in a manner illustrated in FIG. 1, frees the front face 21 from clutter but removes the force gripping control point on the left surface edge 23.

Figure 5:
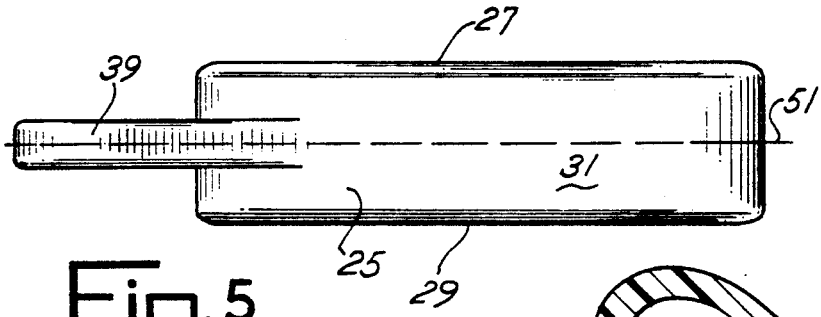
FIG. 5 shows a top view of the soap of FIG. 4.
Figure 8:
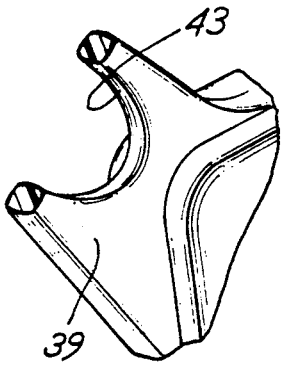
FIG. 8 shows a partial side perspective view of a portion of the finger eye member of the soap of FIG. 4.

Referring to FIGS. 3, 4 and 5, a conventional rectangular soap bar 25 includes a rectangular flat bottom face surface 27 (FIG. 4), a rectangular flat top face surface 29 and four edge surfaces 31, 33, 35, 37.

A projecting member 39 extends from the left edge 37 of bar 25 in an angularly outward and upward direction, as shown. Projecting member 39 includes an opening 41 for receiving the user's fifth finger during gripping of the soap as shown in FIG. 3. Opening 41 is formed of a gripping surface 43 which is generally U-shaped in configuration. The U-shape of surface 43 provides a width to opening 41 for receiving and making contact with the side of the user's fifth finger. Surface 43 opposes the force action of the user's thumb against the right side edge 35 of the bar. As shown in FIG. 5, member 39 is more narrower than soap bar 25, being approximately ⅜ inches in width. This width permits the curling or wrapping of the fifth finger around surface 43 at the opening's lower extent represented by arrow 45. The curling of the fifth finger into contact with the front face 46 of the projecting member 39 serves to provide a force drawing the member 39 and the bar 25 against the user's hand.

As shown in FIG. 4, a cross-section symmetric axis 47 of opening 41 forms an acute angle 49 with the central axis 51 of the bar 25. Opening 41 is positioned solely above the central axis 51.

Figure 6:
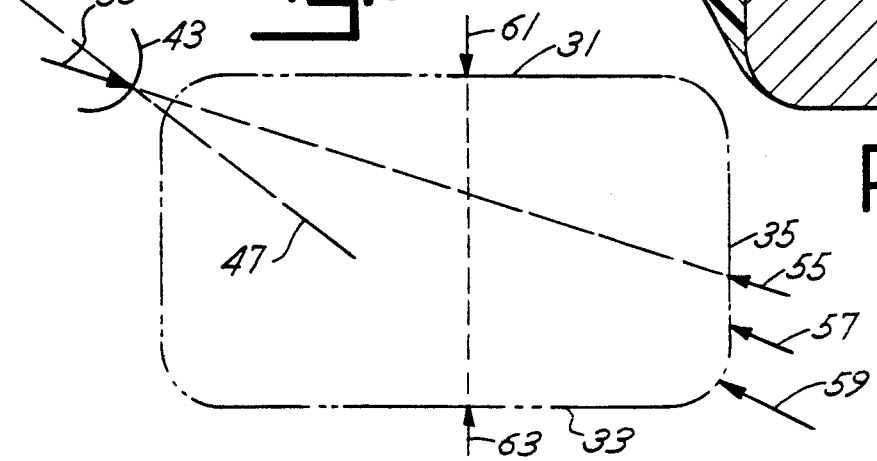
FIG. 6 shows a force diagram of a bar of soap and its gripping surfaces.

As shown in FIG. 6, surface 43 provides an area for receiving a force 53 which opposes a force 55 provided by the thumb of the user against the right surface edge 35 of the bar. As represented by arrows 57 and 59, the force from the user's thumb may be applied at other points along side edge 35. The user's three fingers provide a force 61 on the top surface edge 31 of the bar which opposes the force 63 provided by the user's palm against the lower surface 3 of the bar.

Thus, projecting member 39 provides a surface 43 which receives a force 53 as well as provides a surface 46 which receives a grasping force by the curling of the user's fifth finger. Both of these forces are supplied in the area of the lower extent 45 of the member forming opening 41. Surfaces 43, 46 are located above and below plane 65 which contains the top edge surface 31, and surface 43 is located and spaced leftwardly of the plane 67 which contains the left edge surface 37.

Figure 7:
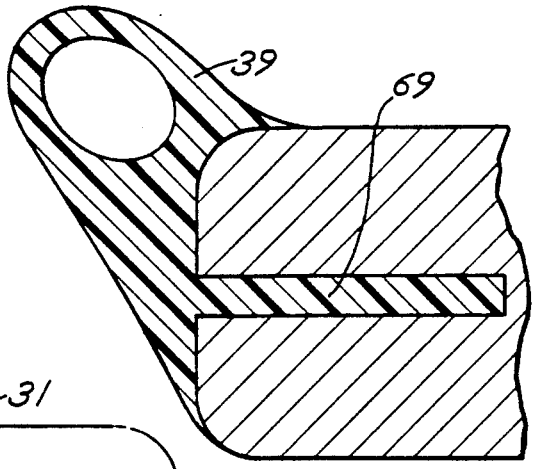
FIG. 7 shows a cross sectional partial side view of the soap of FIG. 4.

Referring to FIG. 7, projecting member 39 is connected to a pin member 69 which extends from projecting member 39 into the interior of soap bar 25. The soap bar is molded around pin 69 or pin 69 is otherwise secured within the soap bar for securing projecting member 39 fixedly to left edge surface 37 of bar 25. Member 39 and pin 69 may be formed integral and made, for example, from a plastic material. Other means besides pin 63 may be used to secure projecting member 39 into a fixed position on soap bar 25.

FIG. 3 illustrates the manner in which the user grips the soaping device 71 formed of the soap bar 25 and the projecting member 39. The user places three central fingers on the top edge surface 31, places his or her thumb on the right edge surface 35 and forces the lower edge surface 33 against the lower portion of the palm of the hand. The user places the fifth finger in opening 41 and provides pressure against gripping surface 43 in order to control the gripping of bar 25. Because opening 41 is positioned upwardly and laterally of left edge surface 37, the user's fifth finger is moved away from the outer surface 29, providing an unobstructed surface for lathering the body.

While only a single, preferred embodiment of the invention has been described herein, those of ordinary skill in the art will recognize that the embodiment may be modified and altered without departing from the central spirit and scope of the invention. Thus, the preferred embodiment described herein is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. Conventional rectangular-shaped bar of soap having like top and bottom surfaces for application of the bottom surface against the body of the user when the user holds the bar in the user's right hand and for application of the top surface against the body of the user when the user holds the bar in user's left hand and having first, second, third and fourth edge surfaces, said first edge surface providing an area for placing of the three central fingers of a hand of the user, said second edge surface providing an area for placing a portion of the lower palm of the user's hand and said third edge surface providing an area for placing of the thumb of the user; and a rigid fifth finger means spaced laterally from said fourth edge surface for providing a gripping surface for receiving the fifth finger of the user when the user's three central fingers are placed on said first edge surface, said gripping surface facing away from said bar of soap for receiving a force from the user's fifth finger in opposition to the force from the user's thumb applied against said third surface.

2. A soaping device according to claim 1 wherein said fifth finger means is positioned solely above the central axis of said bar of soap.

3. A soaping device according to claim 1 wherein said gripping surface is a curved surface positioned in a curved plane intersecting the plane of said first edge surface.

4. A soaping device according to claim 1 wherein said gripping surface is generally U-shaped in configuration.

5. A soaping device according to claim 4 wherein said U-shaped gripping surface includes a cross-section symmetric axis which forms an acute angle with the central axis of said bar of soap.

6. A soaping device according to claim 1 wherein said fifth finger means includes a projecting member including an opening having a continuous circumference.

7. A soaping device according to claim 1 wherein said fifth finger means includes a projecting member having an opening;

and wherein the soaping device further includes means for securing said projecting member to said rectangular bar of soap.

8. A soaping device according to claim 7 wherein said opening is formed of a continuous circumference.

9. A soaping device according to claim 7 wherein said means for securing includes a lateral pin member extending within said bar of soap.

10. A soaping device according to claim 7 wherein said means for securing includes the integral formation of said projecting member to said bar of soap.

* * * * *